US008033241B2

(12) United States Patent
Fulkerson et al.

(10) Patent No.: US 8,033,241 B2
(45) Date of Patent: Oct. 11, 2011

(54) SUPPLY FOR DRY PARTICULATE MATERIAL

(75) Inventors: Terrence M. Fulkerson, Brunswick Hills, OH (US); Donald L. Urig, Elyria, OH (US); Dean A. Koch, Amherst, OH (US)

(73) Assignee: Nordson Corporation, Westlake, OH (US)

( * ) Notice: Subject to any disclaimer, the term of this patent is extended or adjusted under 35 U.S.C. 154(b) by 1076 days.

(21) Appl. No.: 11/425,800

(22) Filed: Jun. 22, 2006

(65) Prior Publication Data

US 2008/0017103 A1 Jan. 24, 2008

(51) Int. Cl.
*B05B 9/03* (2006.01)

(52) U.S. Cl. ..... 118/308; 118/300; 118/310

(58) Field of Classification Search ..... None
See application file for complete search history.

(56) References Cited

U.S. PATENT DOCUMENTS

| | | | | |
|---|---|---|---|---|
| 4,018,185 | A * | 4/1977 | Myers | 118/308 |
| 5,107,756 | A | 4/1992 | Diaz | |
| 5,159,765 | A | 11/1992 | Kramer | |
| 5,173,326 | A * | 12/1992 | Kramer | 427/478 |
| 5,271,695 | A * | 12/1993 | Bischof et al. | 406/114 |
| 5,518,344 | A | 5/1996 | Miller et al. | |
| 5,588,471 | A * | 12/1996 | Lowe | 141/83 |
| 6,398,462 | B1 | 6/2002 | Fulkerson | |
| 6,840,463 | B2 | 1/2005 | Selic | |
| 6,852,164 | B2 | 2/2005 | Kramer | |
| 7,074,274 | B1 | 7/2006 | Shutic et al. | |
| 2001/0003351 | A1 * | 6/2001 | Chen et al. | 239/124 |
| 2002/0046702 | A1 * | 4/2002 | Browning et al. | 118/326 |
| 2005/0126476 | A1 * | 6/2005 | Shutic et al. | 118/308 |
| 2005/0158187 | A1 | 7/2005 | Fulkerson et al. | |

FOREIGN PATENT DOCUMENTS

| | | |
|---|---|---|
| DE | 531859 | 1/1941 |
| DE | 102 61 053 | 7/2004 |
| EP | 0 698 421 | 2/1996 |
| WO | 99/61162 | 12/1999 |
| WO | 00/44504 | 8/2000 |

OTHER PUBLICATIONS

European Search Report dated Dec. 3, 2008, for European Patent Application No. 08 01 6118.
Partial European Search Report dated Aug. 29, 2007.

* cited by examiner

*Primary Examiner* — Michael Kornakov
*Assistant Examiner* — Ryan Coleman
(74) *Attorney, Agent, or Firm* — Calfee, Halter & Griswold LLP

(57) ABSTRACT

A supply or feed center for dry particulate material is modular in design with an application module and an exhaust module, along with optimal cabinet modules such as a pump cabinet module. The application module is partitioned into an application section and a utility section, both of which communicate with the exhaust module. An air diverter may be used to change relative air flow into the two sections, and in one embodiment is a swingable door. The exhaust module may include a self-contained exhaust system including after filters, motor, fan and final filters, or may share energy from a remote exhaust system. An inventive suction device is also provided to extract material from a hopper.

20 Claims, 11 Drawing Sheets

SUPPLY FOR DRY PARTICULATE MATERIAL

TECHNICAL FIELD OF THE INVENTIONS

The inventions relate generally to material application and supply systems, for example, but not limited to, powder coating material application and supply systems. More particularly, the inventions relate to a material feed center or supply for such systems.

BACKGROUND

Material application systems are used to apply one or more materials in one or more layers to an object. General examples are powder coating systems, as well as other particulate material application systems such as may be used in the food processing and chemical industries. These are but a few examples of a wide and numerous variety of systems used to apply particulate materials to an object and to which the present inventions can find realization and use.

The application of dry particulate material is especially challenging on a number of different levels. An example, but by no means a limitation on the use and application of the present inventions, is the application of powder coating material to objects using a powder spray gun. Because sprayed powder tends to expand into a cloud or diffused airborne spray pattern, known powder application systems use a spray booth for containment. Powder particles that do not adhere to the target object are generally referred to as powder overspray, and these particles tend to fall randomly within the booth and will alight on almost any exposed surface within the spray booth. Therefore, cleaning time and color change times are strongly related to the amount of surface area that is exposed to powder overspray.

In addition to exterior surface areas exposed to powder overspray, color change times and cleaning time are strongly related to the amount of interior surface area exposed to the flow of powder during an application process. Examples of such interior surface areas include all surface areas that form the powder flow path, from a supply of the powder all the way through the powder spray gun. The powder flow path typically includes a pump that is used to transfer powder from a powder supply to one or more spray guns. Hoses are commonly used to connect the supply, pumps and guns.

Interior surface areas of the powder flow path are typically cleaned by blowing a purge gas, such as pressurized air, through portions of the powder flow path. Wear items that have surfaces exposed to material impact, for example a spray nozzle in a typical powder spray gun, can be difficult to clean due to impact fusion of the powder on the wear surfaces.

Known supply apparatus for powder coating materials generally involve a container such as a box or hopper that holds a fresh supply of previously unused or 'virgin' powder. This powder is usually fluidized within the hopper, meaning that air is pumped into the powder to produce an almost liquid-like bed of powder. Fluidized powder is typically a rich mixture of material to air. Often, recovered powder overspray is returned to the supply via a feed hose and sieve arrangement. A venturi pump may be used to draw powder through a suction line or tube from the supply into a supply hose and then to push the powder under positive pressure through another hose to a spray gun. Such systems are difficult to clean for a color change operation because the venturi pumps cannot be reverse purged, the suction tubes and associated support frames and pumps retain powder, and there are exterior surfaces that need to be cleaned. The sieve is also challenging and time consuming to clean as it often is in a separate housing structure as part of the powder recovery system or is otherwise not easily accessible. Most of these components need to be cleaned by use of a high pressure air wand which an operator manually uses to blow powder residue back up into a cyclone or other powder recovery unit. Every minute that operators have to spend cleaning and purging the system for color change represents downtime for the system and inefficiency.

There are two generally known types of dry particulate material transfer processes, referred to herein as dilute phase and dense phase. Dilute phase systems utilize a substantial quantity of air to push material through one or more hoses from a supply to a spray applicator. A common pump design used in powder coating systems is the venturi pump which introduces a large volume of air at higher velocity into the powder flow. In order to achieve adequate powder flow rates (in pounds per minute or pounds per hour for example), the components that make up the flow path must be large enough to accommodate the flow with such a high air to material ratio (in other words lean flow) otherwise significant back pressure and other deleterious effects can occur.

Dense phase systems on the other hand are characterized by a high material to air ratio (in other words rich flow). A dense phase pump and related concepts are described in pending U.S. patent application Ser. Nos. 10/711,429 filed on Sep. 17, 2004 for DENSE PHASE PUMP FOR DRY PARTICULATE MATERIAL, and 11/140,759 filed on May 31, 2005 for PARTICULATE MATERIAL APPLICATOR AND PUMP, the entire disclosures of which are fully incorporated herein by reference, and which are owned by the assignee of the present inventions. This pump is realized in general by a pump chamber that is partially defined by a gas permeable member. Material, such as powder coating material as an example, is drawn into the chamber at one end by negative pressure and is pushed out of the chamber through the same end by positive air pressure. This pump design is very effective for transferring material, however, the present inventions are not limited to use with such a pump design. The present inventions are also not limited to use in powder coating material application systems, but rather may find use in any material handling system that needs to provide a supply of dry particulate material, including both dense and dilute phase systems.

SUMMARY

The disclosure is directed to arrangements and methods for providing a supply or feed center for dry particulate material, such as, for example, powder coating material. The various inventive aspects and concepts, however, are not limited to powder coating materials and may find utility with many different types of dry particulate materials.

In accordance with one inventive aspect, a supply is contemplated that is modular in design so as to enhance its general functionality and cleanability. The modular concept in one embodiment includes an application module and an exhaust module. The application module may be cleaned and used with an exhaust air flow that moves powder overspray or residue into the exhaust module. Optionally, the exhaust module may be realized as a self-contained filter and exhaust system, or alternatively may include an arrangement for connection to an after filter/exhaust system. The modular concept may further optionally include one or more cabinet modules, such as for example a pump cabinet module.

In accordance with another inventive aspect, a supply for dry particulate material includes a space or area that is partitioned into first and second sections. The first section may, for example, be used as a supply section to contain a supply of dry particulate material for one or more pumps. The second section may, for example, be used as a cleaning section or other utility section that is not exposed to particulate material from the first section. In accordance with a related optional inventive aspect, a mechanism is provided to modify, adjust or control the relative air flows through the first and second sections. In one embodiment, the mechanism may be realized in the form of a hinged door that operates as an air diverter. The door has first and second positions, for example, that determine air flow into and through the first and second sections. An alternative arrangement may be realized with a supply that is partitioned into more than two sections.

In accordance with another inventive aspect, a device is contemplated for removing material from a hopper or other container of the material, in which the device can function to feed material to a plurality of pumps but have reduced surface area for cleaning. In one embodiment, the device may be realized in the form of a generally cylindrical housing that encapsulates one or more feed hoses connectable to respective pumps. The housing may optionally be formed as a lance that is inserted into a container of material. The lance may be supported on the container by a holder mechanism that includes a wiper or squeegee to help clean the housing exterior surface when the lance is removed from the container.

The present disclosure further provides various inventive aspects relating to methods embodied in the use of such arrangements as will be further described herein below.

These and other inventive aspects, concepts and advantages will be readily understood and appreciated by those skilled in the art from the following detailed description of the exemplary embodiments in view of the accompanying drawings.

DETAILED DESCRIPTION OF EXEMPLARY EMBODIMENTS

Figure 1:
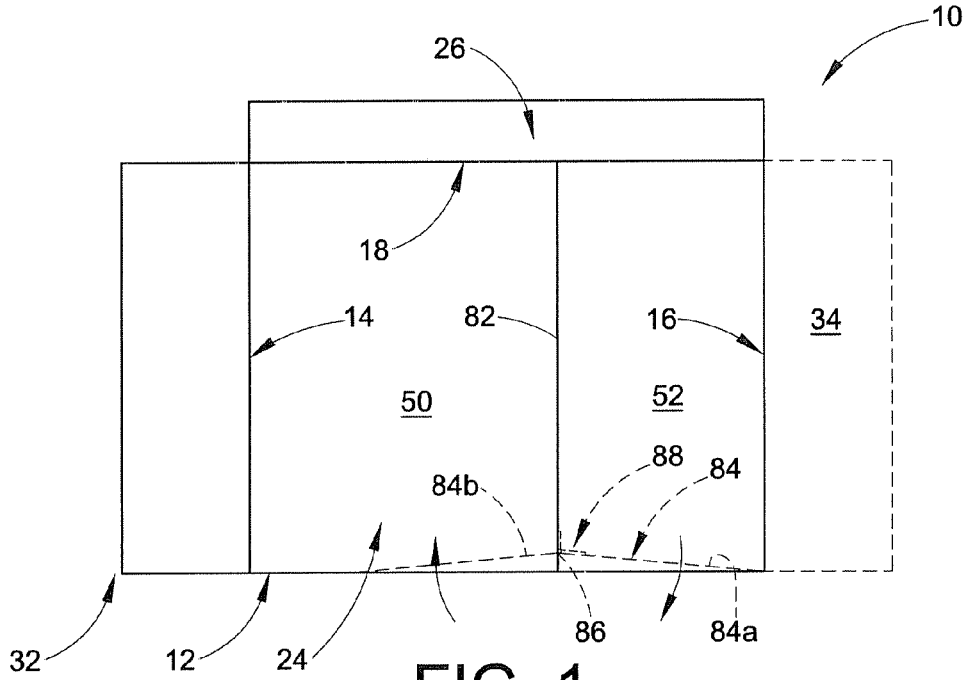
FIGS. 1-3 are simplified schematics of various inventive aspects of the disclosure, with FIGS. 1 and 2 being plan views of a modular supply concept and FIG. 3 being an elevation of a modular supply concept showing exemplary flow paths for material.

The present disclosure is directed to various inventive aspects, concepts and features for a supply, also sometimes known or referred to in the art as a feed center, of dry particulate material. One exemplary material is powder coating material such as may be applied to objects as part of a finishing process, for example. However, the inventive concepts are not limited to powder coating materials. Furthermore, while the exemplary embodiments are described herein in the context of a powder coating system, including specific examples of such a system such as types of spray booths, exhaust systems, spray guns or applicators and pumps, none of these devices are required to be used as described or in their exemplary form.

While the described embodiments herein are presented in the context of a powder coating material application system, those skilled in the art will readily appreciate that the present invention may be used in many different dry particulate material application systems, including but not limited in any manner to: talc on tires, super-absorbents such as for diapers, food related material such as flour, sugar, salt and so on, desiccants, release agents, and pharmaceuticals. These examples are intended to illustrate but not limit the broad application of the invention for dense phase application of particulate material to objects. The specific design and operation of the material application system selected provides no limitation on the present invention unless and except as otherwise expressly noted herein.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sun-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

Figure 2:
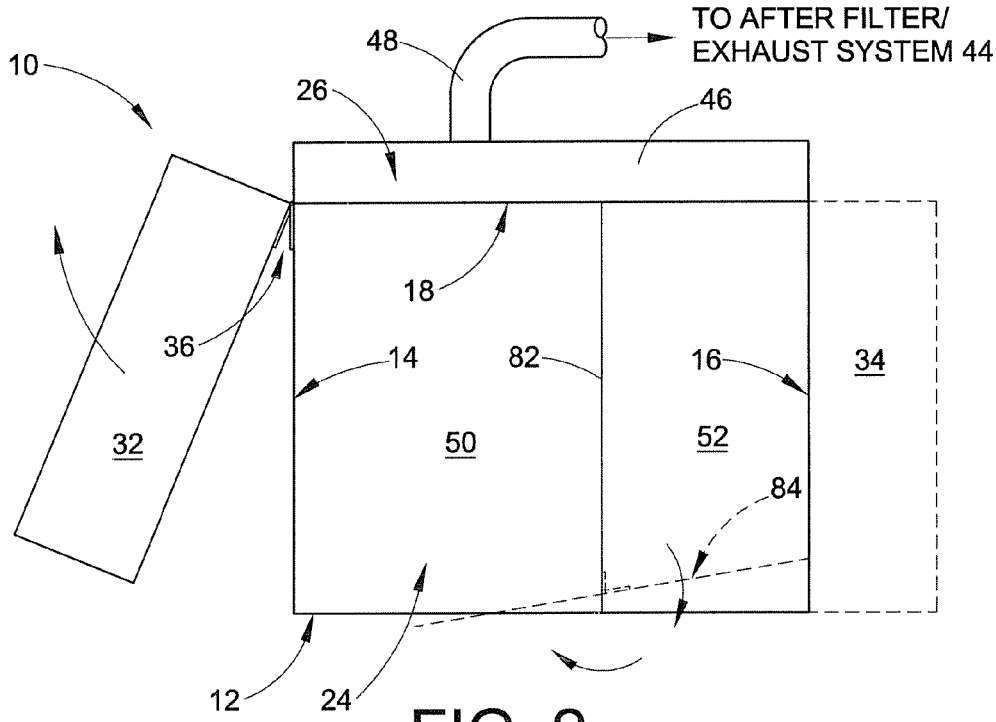

With reference to FIGS. 1 and 2, a modular supply concept is schematically illustrated. We use simplified schematics because the concepts are not limited to any specific realization thereof. The modular supply 10 may be used for example with a powder coating system such as is shown and described in U.S. patent application publication number US-2005-0158187-A1 published on Jul. 21, 2005, of Ser. No. 10/711,429 filed on Sep. 17, 2005 for DENSE PHASE PUMP FOR DRY PARTICULATE MATERIAL, owned by the assignee of the present application and fully incorporated herein by reference. For example, the inventive modular feed center and/or various inventive aspects described herein may be used as part of the feed center 22 in the above pending application. However, the modular supply concept may be used with many and widely varied types of material application systems. Some aspects of the present disclosure are especially useful with dense phase delivery of powder coating material as described in the aforementioned publication, including a dense phase pump as described therein. But, the present disclosure does not require use of any of those specific features.

In FIG. 1, the modular supply 10 includes an enclosure 12 which in this case is a partially enclosed booth that includes first and second side walls 14, 16 and a back wall 18. The back wall 18 is a partial barrier with openings 20, 22 (see FIG. 3). The back wall 18 can generally be thought of as defining or lying in a plane that separates, in general, an application module 24 from an exhaust module 26. By "application module" is meant a space or area in which powder is held in a container for feed to one or more pumps, and may contain additional hoppers in a utility portion. The pumps in the exemplary embodiment are optionally disposed outside of the application module 24 and therefore isolated from airborne powder. By "exhaust module" is meant a space or area into which airborne powder such as residue and blow off flows for collection and removal, either within the exhaust module itself (a self-contained embodiment) or transferred to an after filter/exhaust system disposed away from the supply 10.

Thus, the back wall 18 generally identifies the separation between a working application area 24 for supplying powder and an exhaust or recovery area 26. The back wall openings 20, 22 allow airborne powder to move from the application module 24 into the exhaust module 26, either during a cleaning/color change operation, an application or supply operation or both. A cleaning operation, which may be accompanied by an optional color change operation, involves blowing off powder from all exposed surfaces of the application module 24 into the exhaust module 26 for disposal. This may optionally include back purging of pumps and supply hoses that connect the pumps to a powder hopper or container as will be further described herein.

Figure 3:
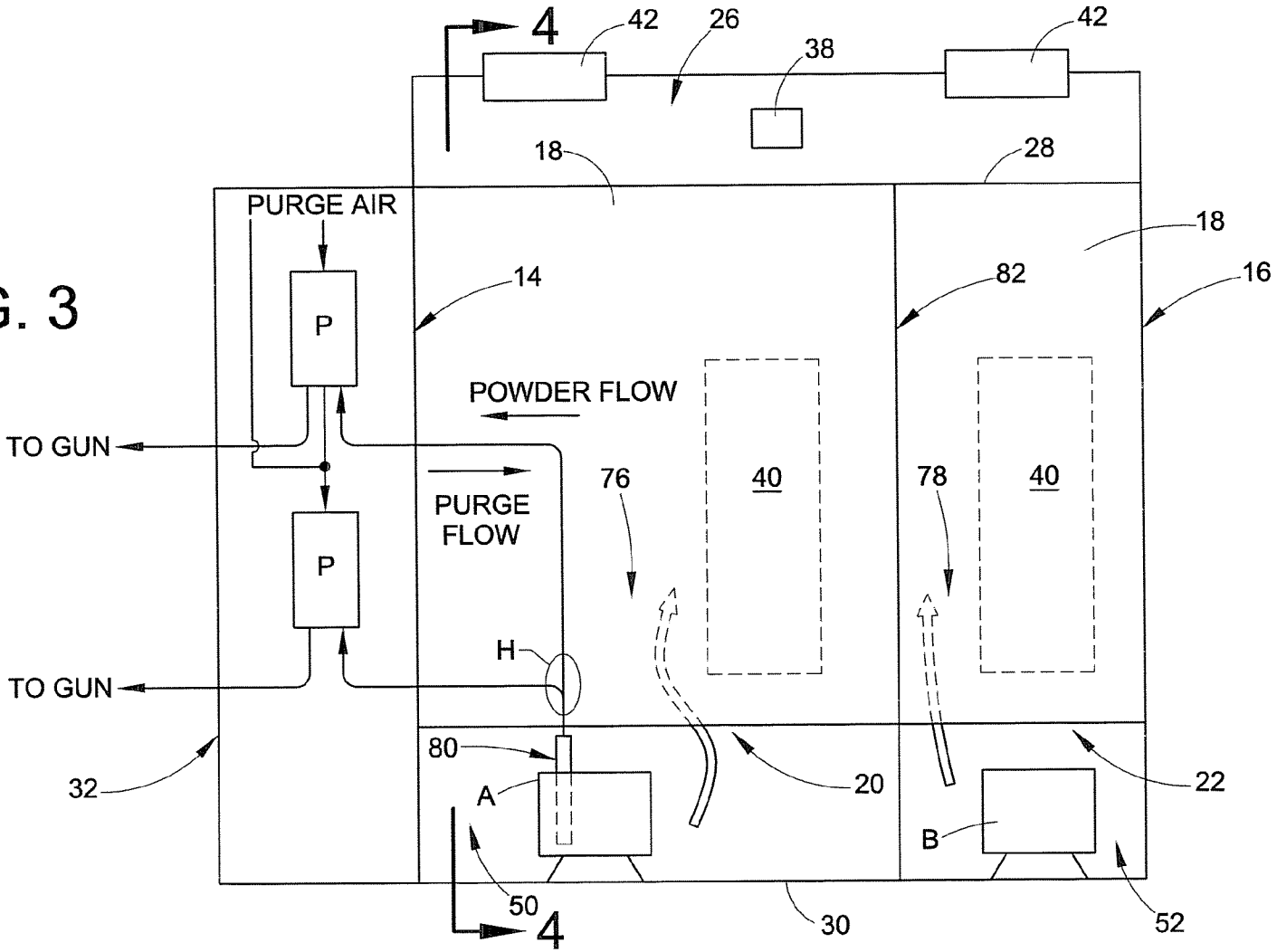

The application module 24 thus may be generally a partially enclosed space or area defined by the two side walls 14, 16, the back wall 18 and a ceiling 28 (FIG. 3), as well as an optional floor 30 (FIG. 3). The arrangement therefore has a generally open front that provides air flow through the application module 24 into the exhaust module 26.

With continued reference to FIG. 1, the modular supply 10 may optionally include one or more cabinet modules 32 used to house equipment such as for example, pumps, electronics, controls, valves and so on. In FIG. 1 there is a first such optional cabinet 32 illustrated as being on one side of the application module 24 and an optional second cabinet 34 on the opposite side represented by dotted line. Note that advantageously the cabinets 32, 34 can be isolated from powder by the presence of the side walls 14, 16 respectively. This allows in some cases for the pumps—for example, the dense phase pumps of the above mentioned patent application publication—to be disposed in the cabinet 32 so that the pumps do not need to be cleaned off. Alternatively, however, other pumps such as venturi pumps that are commonly available may be used but these pumps typically are mounted on the material hopper or container, thus being exposed to powder on external surfaces of the pumps that must then be cleaned for color change, for example. Another inventive aspect therefore is a modular arrangement for a supply that optionally has the pumps isolated from airborne powder in the supply. As best illustrated in FIG. 2, the optional pump cabinets 32, 34 may also optionally be hinged or otherwise made swingable relative to the application module 24 such as with a simple hinge device 36 to allow easier access to the pumps and equipment housed therein.

In the embodiments of FIGS. 1 and 3, the exhaust module 26 may be realized in the form of a self-contained exhaust system that includes an exhaust fan 38 to create air flow through the application module 24 into the exhaust module 26, one or more primary filters 40 to separate powder from the exhaust air and optionally a final filter arrangement 42 to exhaust to air. The specific design features of the self-contained exhaust system are optional and may be conventional in design or specific to a particular application.

FIG. 2 illustrates another optional inventive aspect. In this case, rather than a self-contained exhaust system disposed in the exhaust module 26 adjacent the application module 24, the exhaust module 26 may share the exhaust energy air flow from a remote after filter and exhaust system 44. The after filter and exhaust system 44 may, for example, be the same system that also produces the air flow used for containment and exhaust air for the spray booth and powder recover system (the latter, for example, being a cyclone or filter cartridge arrangement to name two examples.) Or alternatively, the remote system 44 may be a remote stand alone system. In any case, the exhaust module 26 may then be realized in the simplified form of a hood or plenum 46 over or enclosing the back wall 18 and has a duct 48 connected to the after filter/exhaust system 44. The back plane 18 in this embodiment still delimits the application module 24 (where active powder supply operations are performed) from the exhaust module 26. The remotely disposed exhaust system draws powder laden air from the application module 24 into and through the exhaust module 26 and out the duct 48 to the exhaust system for after filter and final filter treatment prior to exhaust to atmosphere.

In the case of a self-contained exhaust module 26 such as shown in FIGS. 1 and 3, powder collects on the cartridge filters 40 and falls to the floor area. Reverse air pulses may be periodically applied to the filters 40 to knock the powder therefrom. The exhaust module 26 may further include means for removing the powder residue to a container or waste.

With reference again to FIGS. 1 and 3 and 4, another inventive aspect of the disclosure is the concept of a partitioned space that provides first and second sections of the supply 10 that may be used for various purposes. The sections are suitably partitioned or separated and designed so that preferably powder material does not cross over between the sections. More than two partitioned sections may be provided but in most cases two is sufficient.

In an exemplary embodiment, the application module 24 is partitioned or split into a first or application section 50 and a second or utility section 52. Which section is used on the left or right (as viewed from the front in FIG. 3) is not critical. The first section may be used as a supply section, for example, to hold a hopper A or other container of material being used as a supply, while the second or utility section allows the operator to perform other functions during an application operation. For example, it is contemplated that the utility section 52 may be used as a cleaning section so that an operator may clean (by air blow off wands for example) equipment or a second hopper B or other container such have may just been used prior to or for a subsequent color. The exhaust module 26 may also be partitioned (not shown) into two sections each with its own filter 40 so as to eliminate powder cross-over between sections.

Figure 4:
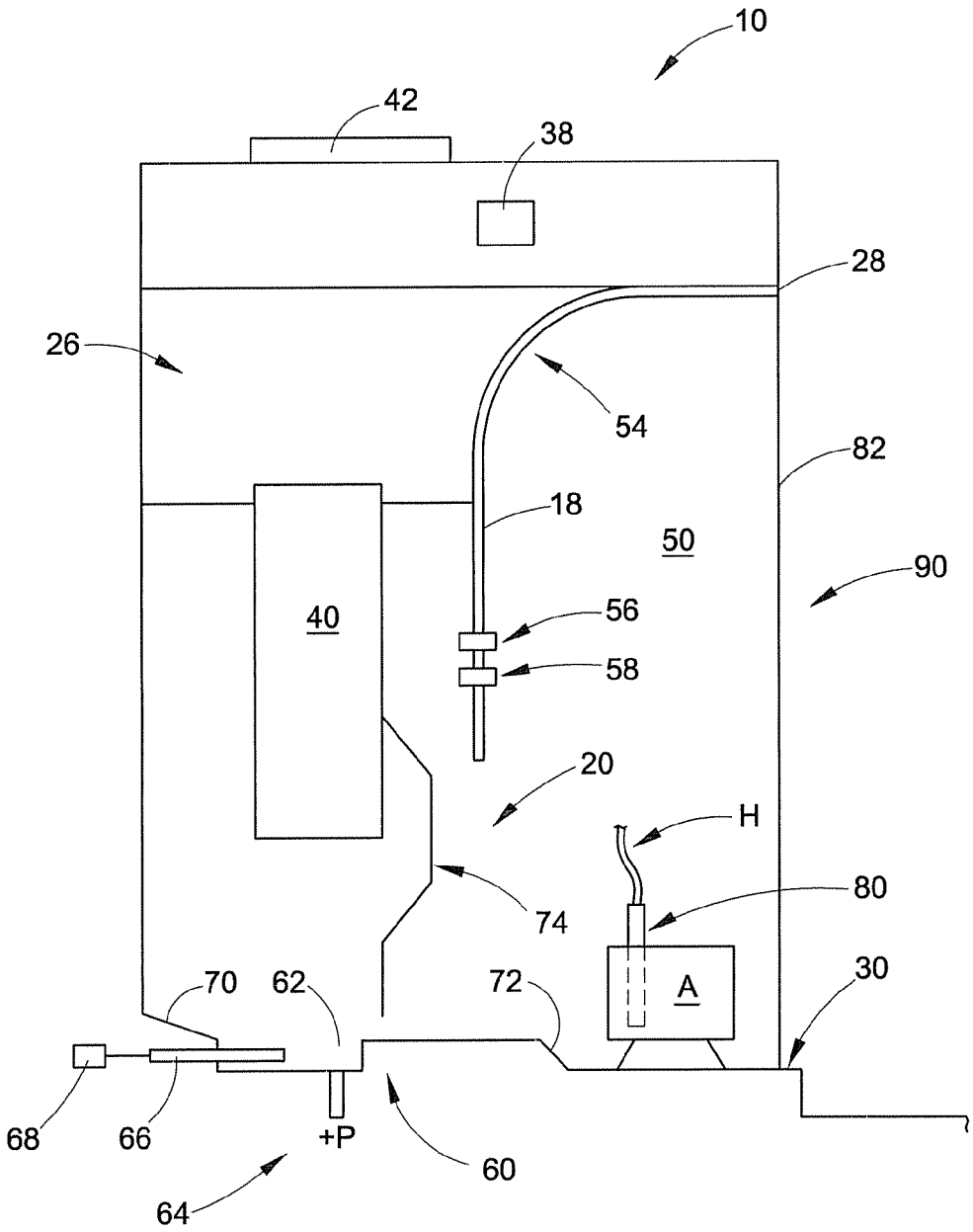
FIG. 4 is an elevation taken along the line 4-4 in FIG. 3.

FIG. 4 shows in a simplified manner some useful and optional features. The back wall 18 (which as noted defines a back plane that demarcates the application module 24 from the exhaust module 26) may have a curve transition 54 to the ceiling 28 to provide good air flow patterns and prevent corner dead spots. Two hollow nipples or tubes 56, 58 may be provided that extend through the back wall 18 into the exhaust module 26. The supply hoses from a powder recovery system or virgin supply (not shown)—which may be optional bulk feed inputs to the supply 10—may be attached to these tubes 56, 58 during a color change to allow the supply hoses to be purged and cleaned. The exhaust module 26 floor 60 may include a trough 62 that collects powder that falls from the filter 40. The trough 62 may optionally include a source of pressurized air 64 to fluidize powder that collects in the trough 62. A suction tube 66 may extend into the trough 62 and connected to a pump 68 such as a venturi pump for example to clean out the powder from the trough 62. The floor 60 may further include a rearwardly sloped portion 70 to facilitate circulation of the airborne powder within the exhaust module 26. The application module floor 30 may also include a rearwardly sloped portion 72 to facilitate the flow of airborne powder from the application module 24 through the opening 20 (and 22 on the cleaning section side) into the exhaust module 26. Optional baffles 74 may also be used to facilitate air flow within the exhaust module 26 and to increase performance of the primary filters 40.

In FIG. 3, the double lined arrows 76, 78 represent the general flow of airborne powder through the openings 20, 22 although the actual air flow pattern may be significantly different.

Another inventive aspect illustrated in FIG. 3 is the use of a suction device 80 that partially inserts into the supply hopper A. The device 80 is described in greater detail below, but generally encapsulates a plurality of feed hoses H that are connected to the pumps P mounted in the pump cabinet 32 (FIG. 1). The pumps P draw powder from the supply hopper A via the powder hoses H. In an exemplary embodiment the pumps are dense phase pumps such as, for example, described in the above-referenced published patent application. Other pumps may be used including venturi pumps that mount on the hopper A. But use of the suction device 80 eliminates powder accumulation on the pumps and is significantly easier to clean. The optional use of the device 80, which for convenience is also called a lance herein due to the nature of its design and use, enhances the functionality of the supply 10 but is not required. Although not shown in FIGS. 1-4, a sieve with optional vibrator may be used as part of the powder reclaim or virgin powder source inside the application section 50 (or alternatively may be positioned outside the application module.)

When the pumps P are of the type described in the above mentioned publication, the pumps can be fully reverse purged so that purge air not only can be directed out to the guns to purge the guns but also purge air will blow powder of the feed hoses H and the inside powder path in the suction device 80. Thus, during a cleaning operation, the lance 80 is removed from the supply hopper A, and may be first blown off and then placed in a holder (shown in later figures herein) so that the purge air blows powder through the lance 80 into the exhaust module 26.

With reference again to FIG. 3, the application or supply section 50 is separated from the utility section 52 by a partitioning wall 82 that may extend from the ceiling 28 to the floor 30. The wall may be transparent so that there is easy observation of each section 50, 52 from the other. The side walls 14, 16 may also be transparent or include partially transparent sections so that an operator can see the pumps P inside the pump cabinet 32.

In accordance with another inventive aspect of the disclosure, a moveable air diverter 84 is provided. In the exemplary embodiment the air diverter may be realized in the form of an optionally hinged door mounted to the front edge 86 of the partition wall 82 with a hinge 88. The door 84 is schematically shown in FIG. 1 and is in a first position 84*a* in which it largely obstructs or reduces air flow into the cleaning section 52 while leaving full air flow into the application section 50 through the open front 90 (FIG. 4) of the feed center 10. This would be the door 84 position, for example, when the application side 50 is being cleaned (so as to allow maximum air flow into the exhaust module 26). The door 84 is swingable or otherwise movable to a second position 84*b* which substantially reduces air flow into the application section 50 and fully opens the cleaning section 52 to air flow. This position may be used, for example, when the cleaning section 52 is being used to clean a hopper, thus allowing maximum air flow into the exhaust module 26. At the same time the application side 50 may be used to supply powder from the hopper A to the pumps P and on to the guns. In this mode, less air is needed to flow into the supply section 50 because there is much less airborne powder to contain. The door 84 also prevents powder from the cleaning section 52 from wrapping around the front of the partitioning wall 82 to the application section 50. The air diverter 84 may optionally be made of clear material and may optionally include one or more holes 85 (see FIG. 5) to balance air flow to a desired amount in the two positions 84*a* and 84*b*.

Figure 5:
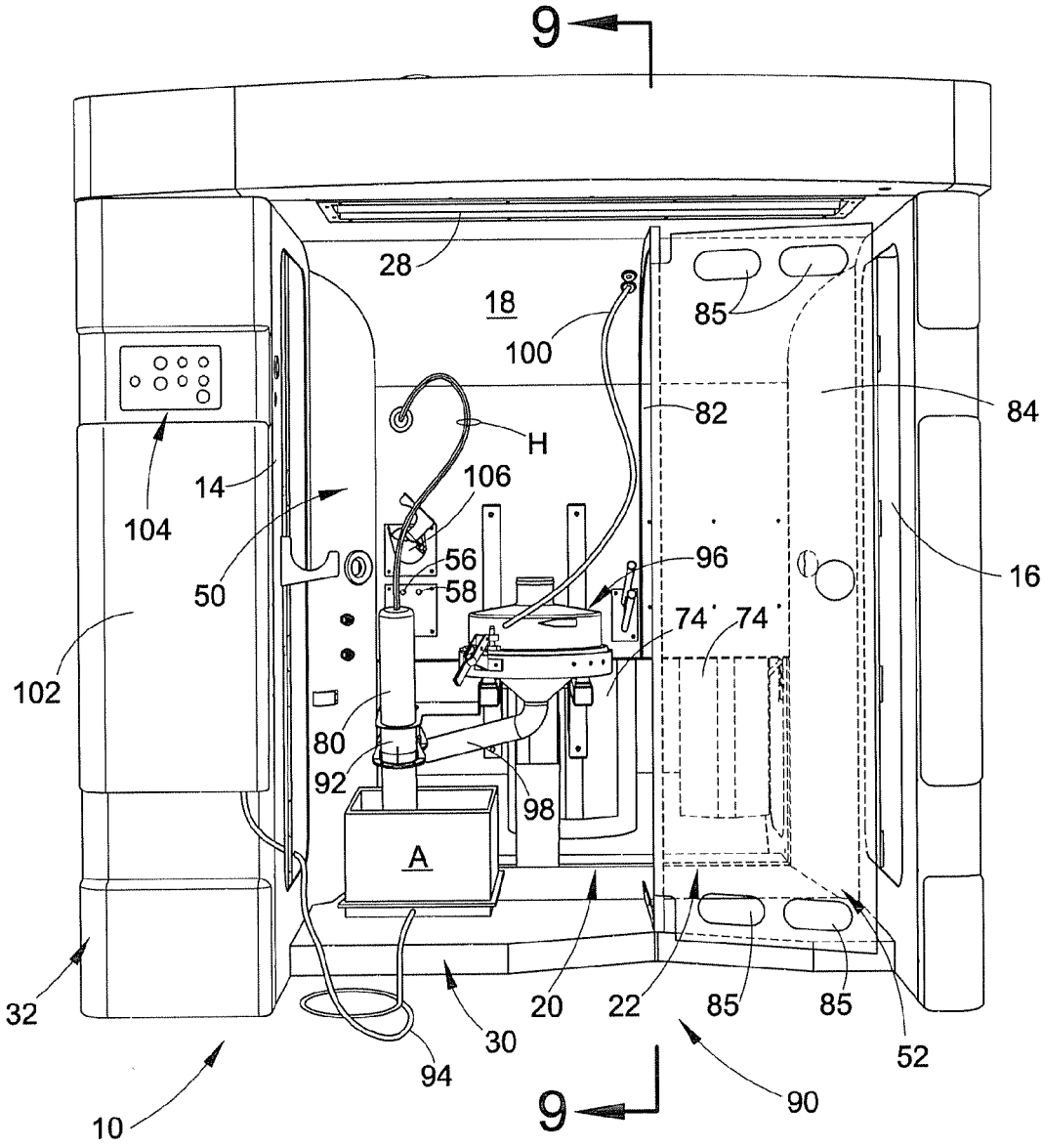
FIG. 5 is a front elevation of a modular supply with an air diverter in a first position.

With reference next to FIG. 5, a more detailed illustration of an exemplary embodiment of the feed center 10 is provided. The basic booth or enclosure 12 for the application module 24 is made of the two side walls 14, 16, a floor 30, a ceiling 28, the back wall 18 and a generally open front 90. The partitioning wall 82 partitions the partially enclosed application module 24 interior space into a first section 50 and a second section 52. The air diverter door 84 is illustrated in the first position 84*a* in which it significantly reduces air flow into the second section 52. Each side of the back wall 18 includes the respective opening 20, 22 which provide air passage from the application module 24 to the exhaust module 26. The supply hopper A is shown in position with the lance 80 inverted for use. A lance holder 92 may be rigidly mounted on a support structure of the walls, or other suitable holders may be used. The holder 92 supports the lance 80 at a position that facilitates the suction of powder from the hopper A. A pressurized air line 94 may be used in the case of optional use of a fluidized hopper A. A sieve 96, which may be of any well known sieve designs—including optionally a vibrating sieve—may be disposed in the application section 50. The sieve 96 may include a discharge pipe 98 that dumps powder into the supply hopper A. Bulk feed hoses 100 provide either or both of reclaimed powder overspray or virgin powder to the sieve 96. The reclaimed powder may come, for example, from a cyclone separator or cartridge filter recovery system.

In FIG. 5 the pump cabinet module 32 is in its closed position. A stationary panel 102 may be used to support a control panel 104 by which an operator can control operation of the feed center 10. For example, the control panel 104 may be used to control operation of the pumps, the sieve and the exhaust system. These control functions are well known and need not be further explained. An optional cradle 106 may be used to hold the lance 80 during a cleaning operation, especially during the time that the pumps P are being purged back through the lance 80. The lance cradle 106 positions the distal end of the lance 80 (i.e., the suction end) within the exhaust module 26 (see FIG. 8) so that the powder blown back from the pumps P, hoses H and the lance 80 is captured by the primary filters 40. The hoses H from the lance 80 are routed out of the enclosure to the pumps P in the cabinet module 32.

Figure 6:
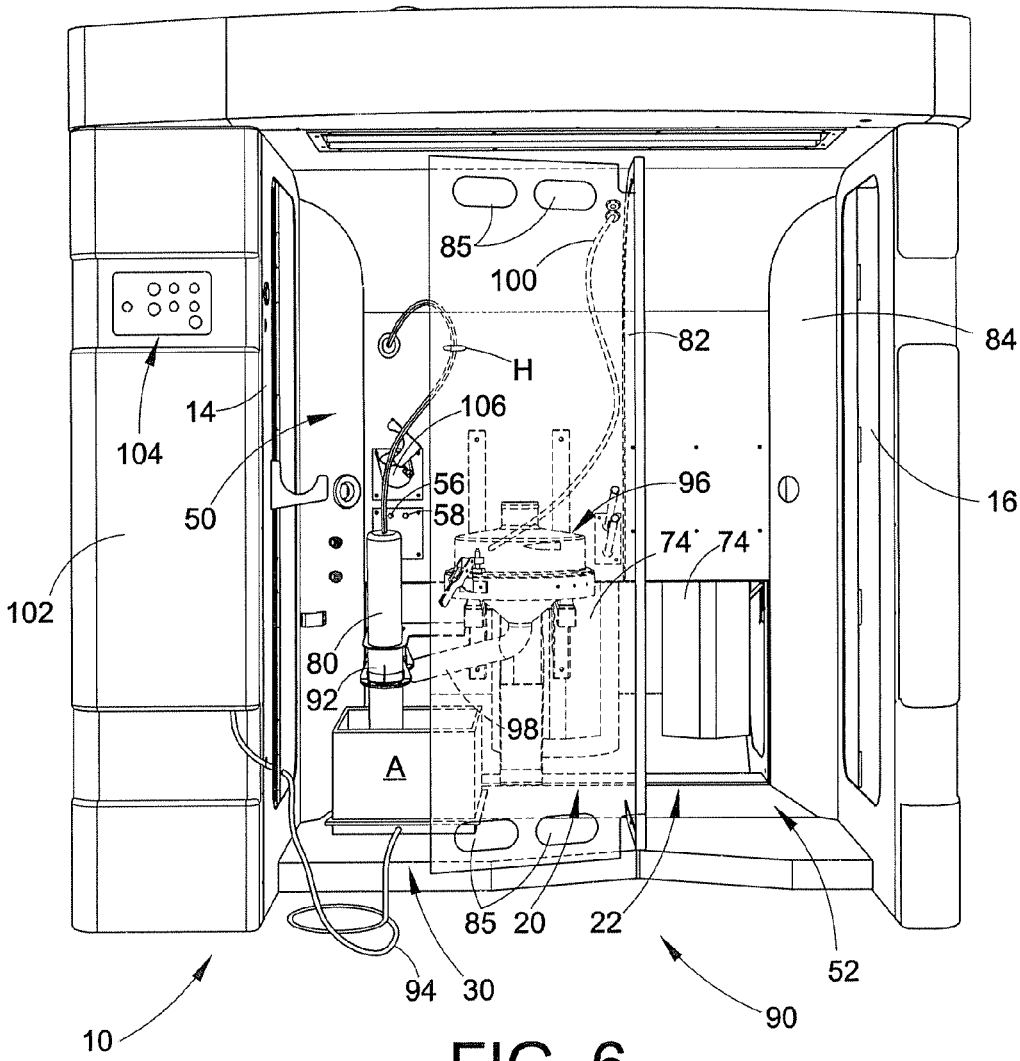
FIG. 6 is the same as FIG. 5 but with the air diverter in a second position.

Note that in its position illustrated in FIG. 5, the air diverter 84 substantially reduces air flow into the cleaning section 52 while leaving air flow into the application section 50 unaffected. In FIG. 6, the air diverter 84 is shown in its second position in which it reduces air flow into the application section 50 but while leaving air flow into the cleaning section 52 unaffected. Many kinds of air diverter concepts may be used with selective amounts of altered air flow patterns as needed for particular applications. The inventive aspect is to provide air diverter means by which the relative air flow into the first and section sections 50, 52 can be adjusted or changed, and optionally helps prevent powder cross-over between the two sections 50, 52.

Figure 7:
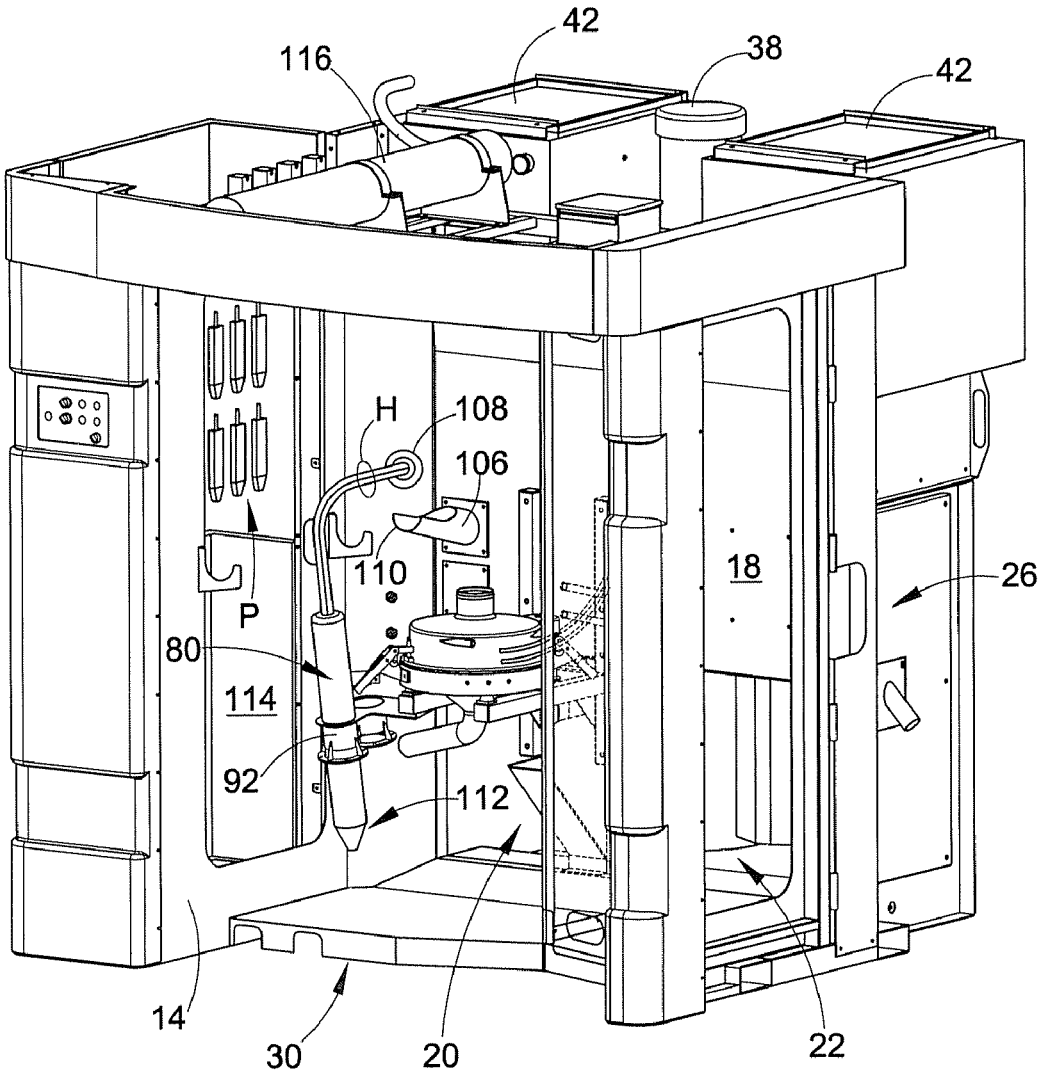
FIG. 7 is a perspective elevation of the supply with an inventive suction device or lance shown in the spray position.
Figure 8:
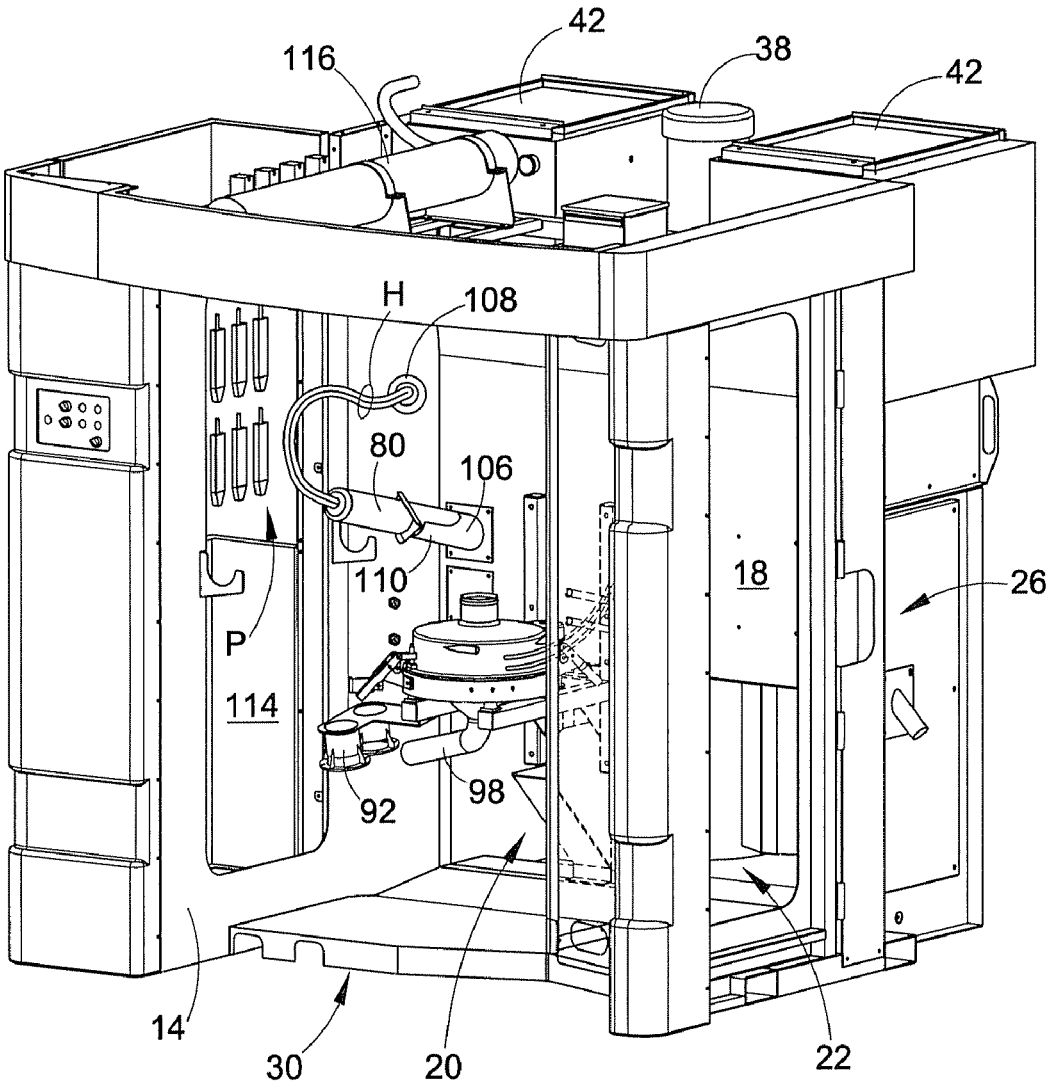
FIG. 8 is the same view of FIG. 7 but with the lance in a purge position.

With references to FIGS. 7 and 8, the two basic positions of the lance 80 are illustrated, with the supply hopper A being omitted for clarity. Although the lance 80 is supported by the holder 92 at an inclination from vertical, the lance 80 may be supported in any suitable orientation. The powder hoses H are routed out of the application module 24 via a hole 108 and connected to the pumps P in the pump cabinet module 32. FIG. 7 illustrates the lance 80 inserted into the lance cradle 106. The lance cradle 106 may include a tray 110 that supports the lance 80 so that the distal end 112 of the lance is positioned within the exhaust module 26. Thus during purge, the pumps P, hoses H and lance 80 are reverse purged with powder blown out of the powder paths and into the exhaust module 26. These figures show how the side wall 14, for example, may include a transparent panel 114 so that the operator can observe pump P operation. An accumulator 116 may be disposed on top of the ceiling 28 to provide purge air for the pumps P.

Figure 9:
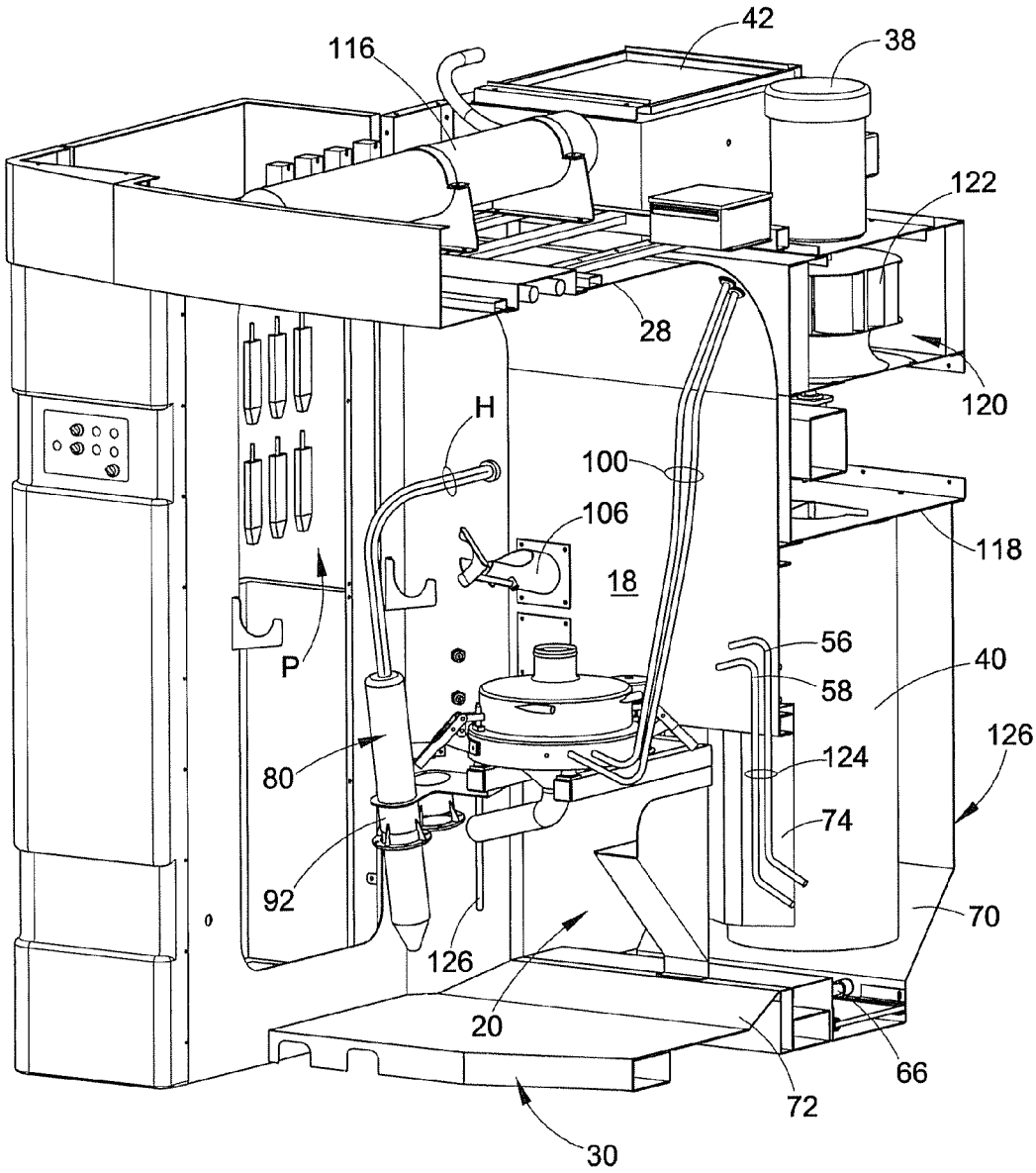
FIG. 9 is a perspective elevation of the supply taken along the line 9-9 in FIG. 5.

FIG. 9 (again with supply hopper A omitted) illustrates additional details of various devices described herein above. The primary filter 40 is supported at its top end by a panel 118 which forms a plenum 120. Filtered air enters the plenum 120 drawn up by the exhaust fan 122. This exhaust air may then optionally be passed through the final filters 42. Hoses 124 may direct airborne powder into the exhaust module 26 from the bulk feed purge tubes 56, 58. A level sensor 126 may be provided to detect when the hopper A (not shown in FIG. 9) requires more powder.

Figure 10:
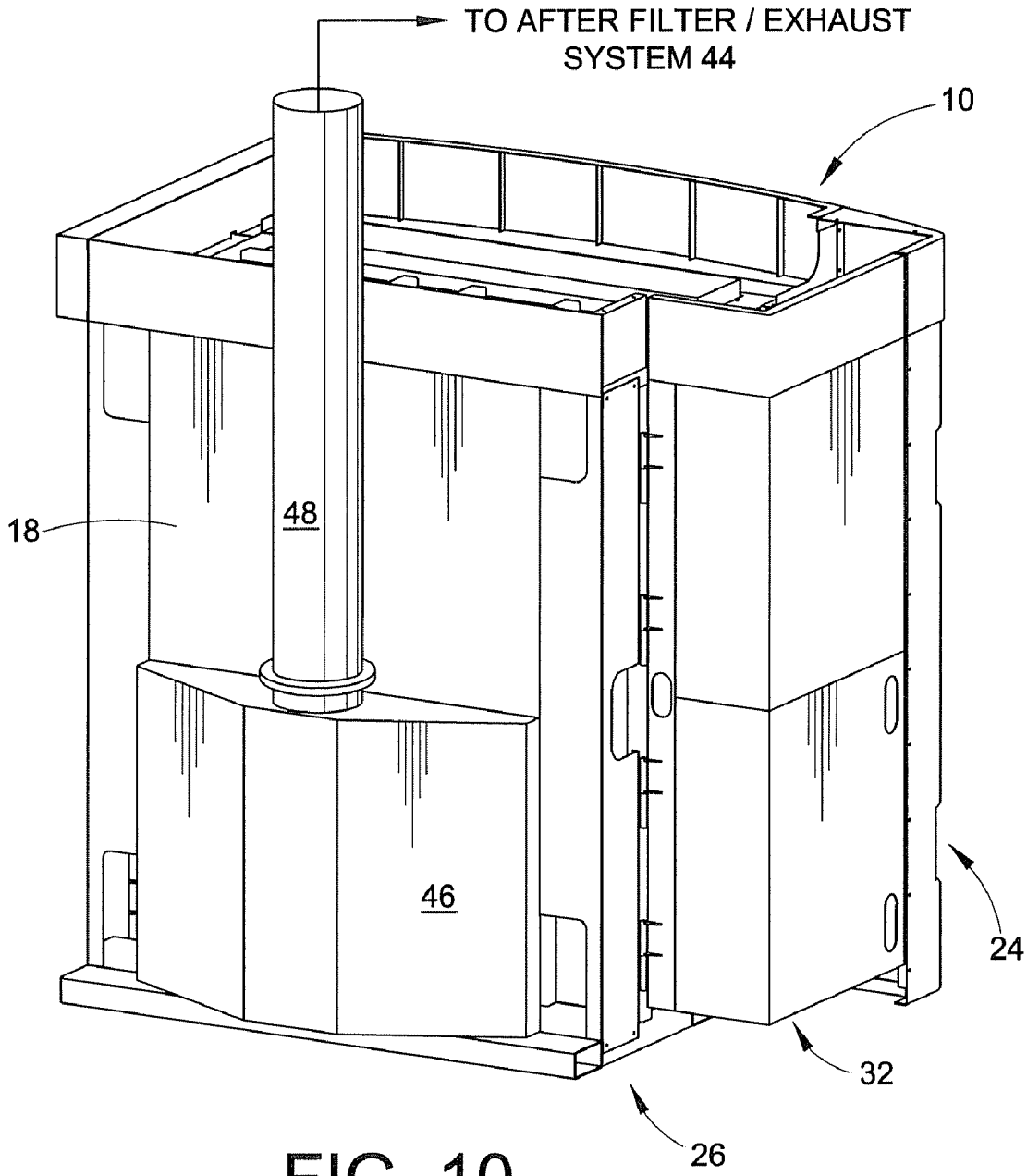
FIG. 10 is a rear perspective illustrating an alternative embodiment of the exhaust module.

FIG. 10 is a more detailed illustration of an exhaust module 26 that shares the energy from a remotely positioned after filter and exhaust system 44 (not shown). The exhaust module 26 in this example includes the hood 46 that encloses a volume or space into which airborne powder is blown through the opening 20, 22 in the back wall 18 (see FIG. 5). Energy from the exhaust system 44 pulls the airborne powder into the hood 46 and out the exhaust duct 48. Many other configurations are possible in order for the supply 10 to share the exhaust energy of a remote exhaust system 44. Note in FIG. 10 the cabinet module 32 is shown in its closed position.

Figure 11:
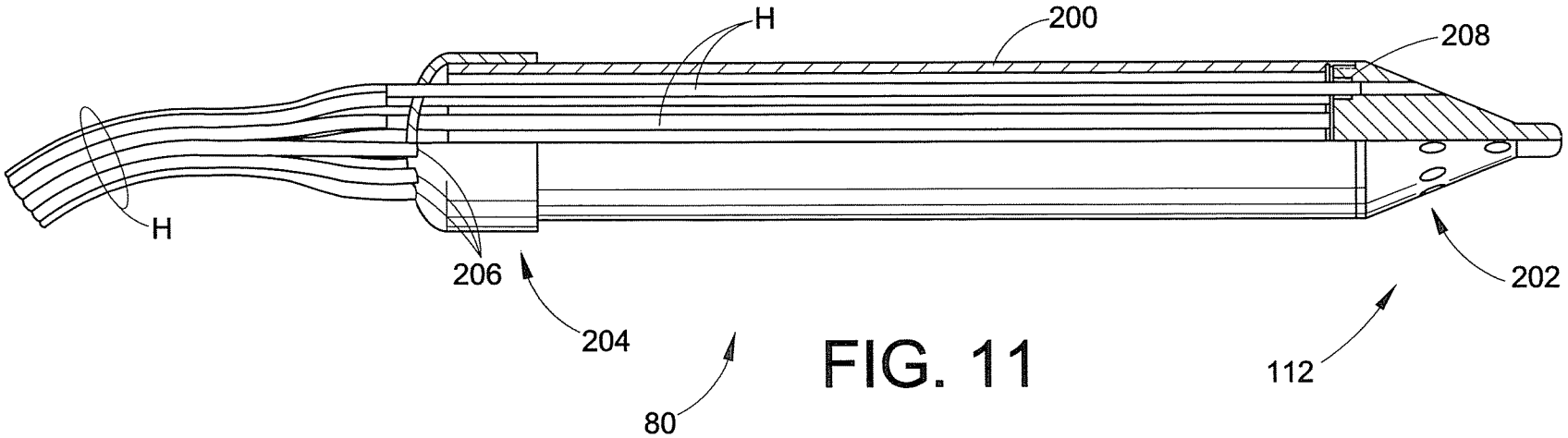
FIG. 11 illustrates an embodiment of an inventive suction device shown in half longitudinal cross-section.

With reference to FIG. 11, the suction device 80 or lance includes a generally cylindrical housing body 200 with a conical head 202 at the distal end 112 and a cap 204 at the opposite end. One or more, and for example 16, powder hoses H, are passed through respective holes 206 in the cap 204, extend through the housing body 200 and insert into respective openings 208 in the back of the head 202. With the hoses H effectively bundled, the cap 204 can simply be press fit attached to the housing 200 although any suitable attachment means may be used as required. The housing body 200 can be threadably connected to the head 202 before the cap 206 is installed. The body 200 and head 202 may be connected by any other suitable means and could alternatively be a single piece. Due to the nature of fluidized powder, it is preferred, though not required, that the body and head be joined or connected together with a dust tight joint there between.

The lance 80 thus effectively encapsulates the portions of the powder hoses H that otherwise would individually be exposed to powder in the supply hopper A. This significantly reduces the exterior surface area needing to be cleaned for a color change. Although a generally cylindrical lance and conical head are preferred, such shapes are not required.

Figure 12:
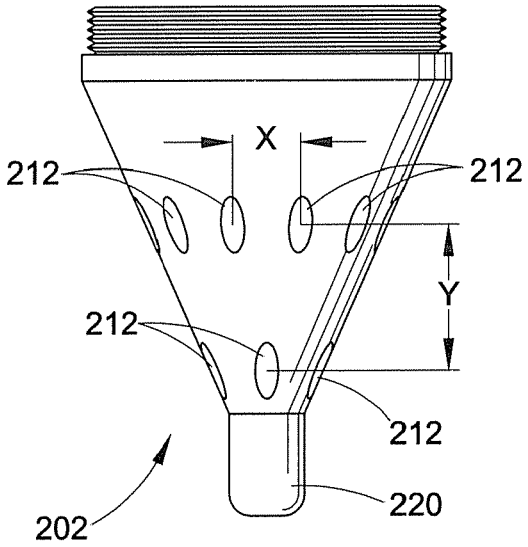
FIGS. 12, 13 and 14 illustrate an elevation, cross-section and rear perspective respectively of a conical head suitable for use with the lance of FIG. 11.
Figure 13:
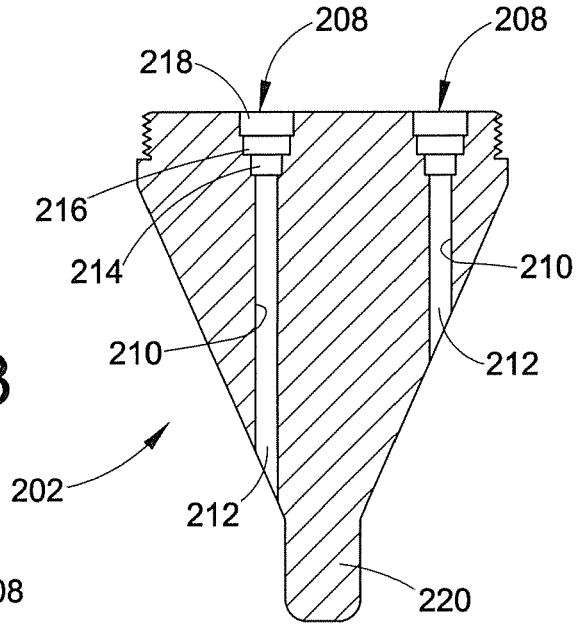
Figure 14:
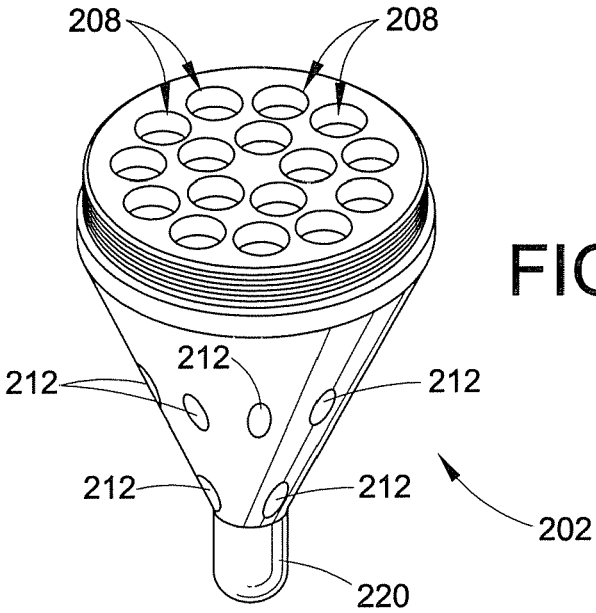

With references to FIGS. 12, 13 and 14, the conical head 202 may be a machined or molded body (the lance 80 generally may be made of plastic or composite materials, for example) with a plurality of suction paths 210 that terminate at suction holes 212. The number of holes 212 can be selected based on how many hoses H will be accommodated by the lance 80, which in turn may be based on the number of pumps (or maximum number of pumps) that may use the lance 80 to supply powder. Suction from the pumps P through the hoses H draw powder in through the holes 212 and the suction paths 210. The distal ends of the hoses H are individually received in a respective opening 208 at the back end of the head 202. As best shown in FIG. 13, each opening 208 includes a first counterbore 214 that receives the hose end, and an optional second counterbore 216 for a seal such as an o-ring (not shown) and an optional third counterbore 218 for a retainer clip (not shown) or other suitable means for securely holding the hose end in the head 202.

The head 202 may optionally include a nose 220 that protrudes so as to prevent the lance 80 from bottoming in the hopper in such a manner as to reduce uptake of powder into one or more of the suction holes 212.

An advantage of the optional conical profile for the head 202 is that the suction holes necessarily have at least horizontal and/or vertical separation with respect to each other, especially as to adjacent holes. The horizontal separation is illustrated by dimension X and vertical separation by dimension Y in FIG. 12. This reduces influence of the individual suction zones of nearby suction holes so that powder may be more uniformly drawn into each suction hole 212. Not all the suction holes and paths need to be used at any given time. Another advantage of the conical shape is that an air wand or other pressurized air source can be used to blow powder off the head 202 by directing the air down along the conical surface from back to front which reduces blow back of powder up into the suction paths 210. When less than all of the suction paths will be used, the hoses H may be installed in any suitable pattern to promote uniform powder pickup for the individual hoses.

Exemplary methods will now be described, however, the various steps may be optional depending on overall system design and may be carried out in a difference order or sequence as needed.

For a spraying operation, the lance 80 is manually inserted into the lance holder 92 so that the distal end 112 is positioned within the hopper A (see FIG. 5). The material application system can be turned on including activating the pumps P to being supply powder from the hopper A. Recovered powder overspray or virgin powder or both may be pumped to the sieve 96 and dumped into the hopper A as needed. The air diverter 84 may be in any position during a spray application but if the operator wants to use the utility section 52, the operator swings the door to the left position (FIG. 6) so as to maximize air flow into the utility section 52. A second hopper or other equipment can be placed in the utility section 52 and blown off with an air wand or other suitable cleaning device.

For a color change operation, the operator swings the air diverter to the position in FIG. 5 which substantially reduces air flow into the utility section 52 and opens the application section 50 to high air flow. The operator—again using an air wand or other suitable cleaning apparatus—can blow off the interior exposed surfaces of the application section 50 including but not limited to the walls, floor, ceiling, sieve components, exposed hoses H and so on. The operator manually extracts the lance 80 from the holder 92. The holder 92 squeegee wipes the outer surface of the lance 80 as the lance is pulled out and the dislodged powder falls into the hopper A. The operator can also blow off the lance 80 and the holder 92. Final blow off can be done after the hopper A is removed. The lance is manually positioned in the cradle 106 at which time the pumps P, hoses H and the lance 80 can be reverse purged. The bulk feed lines 100 may be disconnected from the sieve 96 and attached to the purge tubes 56, 58 so that these lines can be purged by reverse purge of the bulk feed pumps. During the color change or cleaning operation the exhaust system is operational to draw airborne powder into the exhaust module 26. After the application module 24 and everything inside the module are clean, a new supply hopper can be positioned for use during the next spray coating application.

The inventions have been described with reference to exemplary embodiments. Modifications and alterations will occur to others upon a reading and understanding of this specification and drawings. The inventions are intended to include all such modifications and alterations insofar as they come within the scope of the appended claims or the equivalents thereof.

We claim:

1. A system for supplying powder coating material from a powder hopper to a plurality of powder coating spray guns, comprising:

a powder hopper, a plurality of pumps, each pump having a gun supply hose for supplying powder coating material to a spray gun and a powder inlet for receiving powder coating material from said hopper, and a lance, said lance comprising a hollow housing and a head element attached at one end of said hollow housing, said lance comprising a respective powder conduit through which powder coating material is supplied to said powder inlet of each pump, each said conduit extending through said hollow housing from said head element to at least a second end of said hollow housing opposite said one end of said hollow housing; said head element comprising an outer surface that is perforated, each of said powder conduits having outer surfaces that are enclosed in said hollow housing between said head element and said second end of said hollow housing to prevent exposure to powder, said lance being adapted to be positioned with said head element within said hopper, wherein when said pumps are operated, powder coating material is drawn from the hopper into said perforated head element and through said powder conduits to said pumps, and wherein powder coating material is then pushed by said pumps through said gun supply hoses to said spray guns.

2. The system of claim 1 wherein said housing is cylindrical and said head element comprises a conical exterior surface.

3. The system of claim 1 wherein said head element comprises a nose which projects out from an end of said head element.

4. The system of claim 1 wherein said lance further comprises an end cap attached to the opposite end of said hollow housing from said head element, said end cap having a plurality of holes, said powder conduits passing through at least some of said holes to said pumps.

5. The system of claim 1 wherein said powder conduits are attached inside said hollow housing to said head element.

6. The system of claim 1 further comprising a holder for said lance, said holder positioning said head element of said lance within said hopper.

7. The system of claim 6 wherein said holder includes a wiper element which makes contact with an exterior surface of said hollow housing.

8. The system of claim 1 wherein said hopper is located in a housing, said housing comprising a wall with an opening formed in said wall, and a cradle attached to said opening to support said lance in a position wherein said lance extends through said wall with said head element of said lance positioned on the opposite side of said wall from said hopper.

9. The system of claim 8 wherein said opposite side of said wall is enclosed by walls and is connected to a source of suction.

10. The system of claim 1 wherein the outer surface of the head element is perforated with a plurality of holes.

11. The system of claim 10 comprising a separate suction path for each said hole.

12. The system of claim 1 wherein said lance encapsulates the powder conduits to prevent said powder conduit outer surfaces being exposed to powder coating material passing through said head element perforated outer surface.

13. The system of claim 11 wherein each powder conduit is removably connected to one of said plurality of holes in said perforated outer surface of said head element.

14. The system of claim 1 wherein said head element is threadably attached to said one end of said hollow housing.

15. The system of claim 14 comprising an end cap that slides over a second end of said hollow housing.

16. The system of claim 4 wherein said end cap slides over one end of said hollow housing.

17. A system for supplying powder coating material from a powder hopper to a plurality of powder coating spray guns, comprising:

a powder hopper, a plurality of pumps, each pump having a gun supply hose for supplying powder coating material to a spray gun and a powder inlet for receiving powder coating material from said hopper, and a lance, said lance comprising a hollow housing and a head element attached at a first end of said hollow housing, a plurality of powder flow paths extending through said hollow housing from said first end to a second end of said hollow housing that is opposite said first end, said head element comprising an outer surface that is perforated, each said powder flow path comprising a conduit having an interior surface exposed to powder flowing through said conduit and an exterior surface, said hollow housing and said head element encapsulating said powder flow paths to prevent powder coating material that flows through said head element perforated outer surface from adhering to said exterior surfaces of said powder flow paths, said lance being adapted to be positioned with said head element within said hopper, wherein when said pumps are operated, powder coating material is drawn from the hopper into said perforated head element and through said powder flow paths to said pumps, and wherein powder coating material is then pushed by said pumps through said gun supply hoses to said spray guns.

18. The system of claim 17 wherein each powder flow path is removably connected to one of a plurality of holes in said perforated outer surface of said head element.

19. The system of claim 17 wherein said head element is threadably attached to said first end of said hollow housing.

20. The system of claim 17 comprising an end cap that slides over a second end of said hollow housing.

* * * * *